US009030332B2

(12) United States Patent
Tafazoli Bilandi et al.

(10) Patent No.: US 9,030,332 B2
(45) Date of Patent: May 12, 2015

(54) METHOD AND APPARATUS FOR GENERATING AN INDICATION OF AN OBJECT WITHIN AN OPERATING AMBIT OF HEAVY LOADING EQUIPMENT

(75) Inventors: Shahram Tafazoli Bilandi, Vancouver (CA); Nima Nabavi, Vancouver (CA); Arya Ohadi Esfahani, Vancouver (CA); Ian Law Bell, Vancouver (CA)

(73) Assignee: Motion Metrics International Corp., Vancouver (CA)

( * ) Notice: Subject to any disclaimer, the term of this patent is extended or adjusted under 35 U.S.C. 154(b) by 263 days.

(21) Appl. No.: 13/531,166

(22) Filed: Jun. 22, 2012

(65) Prior Publication Data

US 2012/0327261 A1 Dec. 27, 2012

(51) Int. Cl.

| | |
|---|---|
| ***G08B 21/00*** | (2006.01) |
| ***E02F 9/24*** | (2006.01) |
| ***E02F 9/26*** | (2006.01) |

(52) U.S. Cl.

CPC . *E02F 9/24* (2013.01); *E02F 9/262* (2013.01); *E02F 9/265* (2013.01)

(58) Field of Classification Search

CPC ..... G08B 13/08; G08B 21/24

USPC ..... 340/945, 686.1, 686.6, 435–436, 340/679–680, 685; 701/301; 348/222.1, 348/E05.031, E05.022, 207.99

See application file for complete search history.

(56) References Cited

U.S. PATENT DOCUMENTS

| | | | | |
|---|---|---|---|---|
| 4,516,117 | A * | 5/1985 | Couture et al. | 340/685 |
| 5,198,800 | A * | 3/1993 | Tozawa et al. | 340/573.1 |
| 6,102,373 | A * | 8/2000 | Amsinger | 256/1 |
| 6,393,362 | B1 | 5/2002 | Burns | |
| 6,784,800 | B2 * | 8/2004 | Orzechowski | 340/679 |
| 6,894,621 | B2 * | 5/2005 | Shaw | 340/685 |
| 6,985,085 | B1 * | 1/2006 | Brown | 340/685 |
| 7,603,235 | B2 | 10/2009 | Makela et al. | |
| 8,248,263 | B2 * | 8/2012 | Shervey et al. | 340/686.1 |
| 8,315,789 | B2 * | 11/2012 | Dunbabin et al. | 701/301 |
| 8,350,714 | B2 * | 1/2013 | Trim | 340/686.6 |
| 8,707,595 | B2 * | 4/2014 | Beemsterboer et al. | 40/515 |
| 8,731,777 | B2 * | 5/2014 | Castaneda et al. | 701/41 |
| 2007/0164873 | A1 * | 7/2007 | Yamada et al. | 340/679 |
| 2010/0036645 | A1 * | 2/2010 | McAree | 703/1 |
| 2011/0046813 | A1 * | 2/2011 | Castaneda et al. | 701/2 |

* cited by examiner

*Primary Examiner* — Eric M Blount

(74) *Attorney, Agent, or Firm* — Christie, Parker & Hale, LLP

(57) ABSTRACT

A method, apparatus and system for generating an indication of an object within an operating ambit of heavy loading equipment is disclosed. The system includes a plurality of sensors disposed about a periphery of the loading equipment, each being operable to generate a proximity signal in response to detecting an object within a coverage region of the sensor, the proximity signal including an indication of at least an approximate distance between the sensor and the object. A processor circuit is operably configured to define an alert region extending outwardly and encompassing swinging movements of outer extents of the loading equipment. The processor circuit is operably configured to receive proximity signals from the plurality of sensors, process the signals to determine a location of the object relative to the loading equipment, and initiate an alert when the location falls within the alert region.

49 Claims, 9 Drawing Sheets

METHOD AND APPARATUS FOR GENERATING AN INDICATION OF AN OBJECT WITHIN AN OPERATING AMBIT OF HEAVY LOADING EQUIPMENT

CROSS REFERENCE TO RELATED APPLICATIONS

This patent application claims the benefits of U.S. Provisional Patent Application Ser. No. 61/501,546, filed on Jun. 27, 2011, the entire content of which is hereby expressly incorporated by reference.

BACKGROUND OF THE INVENTION

1. Field of Invention

This invention relates generally to operating of loading equipment and more particularly to generating an indication of an object within an operating ambit of heavy loading equipment.

2. Description of Related Art

A common concern when operating heavy loading equipment is the risk of collision with other equipment working in close proximity to the loading equipment. Heavy loading equipment such as mining shovels and other mining or loading equipment may execute frequent and swift swinging actions resulting in danger for other equipment operating within a swing radius of the loading equipment. Electric Mining shovels in particular suffer from limited visibility and the counterweight of most large shovels will generally align with cabs of bulldozers and graders, which commonly operate in close proximity to the shovel.

Cameras have been provided on shovels to alleviate the limited vision of the operator. However visibility may be compromised in poor weather conditions or extremely dusty conditions. Additionally, operating a mining shovel requires a high level of concentration, which makes it difficult for the operator to monitor images displayed in the operating cabin of the shovel to determine risk of collision. A further challenge exists due to the geometry of the shovel which makes it difficult to judge whether the swing path of the shovel is clear of obstructions, since the swing axis of the shovel is in most cases not at the centre of the body.

There remains a need for improved collision avoidance methods and apparatus for loading equipment and particularly for loading equipment that in which a working implement is swung through an arc during operations. Examples of such equipment may include but are not limited to electric mining shovels, mining blasthole drills, hydraulic shovels, rope shovels, cranes, draglines, and bucket wheel excavators.

SUMMARY OF THE INVENTION

In accordance with one aspect of the invention there is provided an apparatus for generating an indication of an object within an operating ambit of heavy loading equipment. The apparatus includes a processor circuit operably configured to define an alert region extending outwardly from the loading equipment and encompassing swinging movements of outer extents of the loading equipment during operation. The processor circuit is also operably configured to receive proximity signals from a plurality of sensors disposed about a periphery of the loading equipment, each sensor being operable to generate a proximity signal in response to detecting an object within a coverage region of the sensor, the proximity signal including an indication of at least an approximate distance between the sensor and the object. The processor circuit is further operably configured to process the proximity signals to determine a location of the object relative to the loading equipment, and initiate an alert when the location falls within the alert region.

A plurality of detection zones may be defined for each sensor, the detection zones extending outwardly from the sensor and the processor circuit may be operably configured to receive the proximity signals by receiving a proximity signal including information identifying one of the detection zones within which the object is located.

The processor circuit may be operably configured to define the alert region by, for each sensor, associating ones of the plurality of detection zones with the alert region.

The processor circuit may be operably configured to define the alert region by receiving positioning information defining a positioning of each sensor on the periphery of the loading equipment.

Swinging movements of the loading equipment during loading operations may occur about a pivot and the processor circuit may be operably configured to receive information defining a location of the pivot and a location of the extents of the loading equipment.

Adjacently disposed sensors on the periphery of the loading equipment may each have at least one detection zone that overlaps with a detection zone of the adjacently disposed sensor and the processor circuit may be operably configured to process the proximity signals by combining the information identifying respective detection zones associated with the adjacently disposed sensors to determine the location of the object.

Swinging movements of the loading equipment during loading operations may occur about a pivot and the processor circuit may be operably configured to define the alert region by defining a region extending outwardly from the pivot.

The processor circuit may be operably configured to define the region extending outwardly from the pivot by defining a generally cylindrical sector having a radius dimension corresponding to a distance between the pivot and an outermost extent of the outer extents.

The processor circuit may be operably configured to define the alert region by defining at least one of a collision region, where objects located within the collision region would be disposed in a collision path of the operating equipment, and defining a warning region extending outwardly from the collision region, where objects located within the warning region may be outside of the collision region but sufficiently close to the collision region to be in danger of encroaching on the collision region.

Swinging movements of the loading equipment during loading operations may occur about a pivot and the processor circuit may be operably configured to define the collision region by defining a generally cylindrical sector having a radius dimension corresponding to a distance between the pivot and an outermost extent of the outer extents.

The processor circuit may be operably configured to define the warning region by defining a generally hollow cylinder shaped sector extending outwardly from the collision region.

The processor circuit may be further operably configured to determine a pattern of movement between an object within the warning zone with respect to the loading equipment, and to determine whether the pattern of movement corresponds to a pattern of movement associated with normal operations of the loading equipment, and initiate the alert by issuing an alert only when the pattern of movement does not correspond to a pattern of movement associated with normal operations of the loading equipment.

Swinging movements of the loading equipment during loading operations may occur about a pivot and the processor circuit may be operably configured to determine whether the pattern of movement of the object corresponds to normal operations of the loading equipment by determining whether movement of the object generally corresponds to a movement about the pivot.

The processor circuit may be operably configured to record location information associated with objects that enter the operating ambit of the loading equipment to facilitate analysis of loading operations.

The loading equipment may include at least one camera disposed to capture images of at least a portion of the operating ambit and the processor circuit may be operably configured to initiate the alert by causing a view of at least the portion of the operating ambit to be displayed on a display for viewing by an operator of the loading equipment when the object is located within a field of view of the at least one camera.

The loading equipment may include a plurality of cameras disposed to capture images of respective portions of the operating ambit and the processor circuit may be operably configured to initiate the alert by selectively displaying a view captured by a camera of the plurality of cameras that is best disposed to provide a view of the object.

The processor circuit may be operably configured to initiate the alert by at least one of causing an audible tone to be produced for warning an operator of the loading equipment, causing an audible tone to be produced for warning an operator of the object, causing a visual alert to be displayed on a display associated with operations of the loading equipment, causing a warning light within view of the operator of the object to be activated, generating a wireless alert signal for receipt by other equipment located in the vicinity of the operating ambit of the loading equipment, and generating a wireless alert signal for receipt by a dispatch center, the dispatch center being in communication with at least one of an operator of the loading equipment and an operator of the object.

The loading equipment may include at least one outwardly directed warning light for providing a warning to an object entering the operating ambit of the loading equipment and the processor circuit may be operably configured to initiate the alert by activating the at least one warning light.

The loading equipment may include a plurality of outwardly directed warning lights disposed about the periphery of the loading equipment and the processor circuit may be operably configured to initiate the alert by selectively activating one of the plurality of warning lights that is disposed to provide a visual alert to an operator of the object.

The processor circuit may be operably configured to further determine an object type associated with the object and to generate a signal operable to halt operation of at least one of the object and the loading equipment when the location falls within the alert region.

The processor circuit may be operably configured to determine the object type by at least one of performing image analysis on an image of the object captured by a camera disposed to capture images of at least a portion of the operating ambit with the object is located, reading a radio frequency identification associated with the object, and processing the proximity signals produced by the sensors, the sensors being further operably configured to provide information indicative of a shape of detected objects within a coverage region of the sensor.

The loading equipment may include one of an electric mining shovel and a hydraulic mining shovel.

The outer extents may include a counterweight of the mining shovel.

The sensor may include a radar object detection sensor.

The processor circuit may be operably configured to further use the processed proximity signals to generate statistical data representing a number of detections within a coverage region of at least one of the plurality of sensors.

The processor circuit may be operably configured to generate a map representing the number of detections within the coverage region of each of the plurality of sensors.

In accordance with another aspect of the invention there is provided a method for generating an indication of an object within an operating ambit of heavy loading equipment. The method involves defining an alert region extending outwardly from the loading equipment and encompassing swinging movements of outer extents of the loading equipment during operation. The method also involves receiving proximity signals from a plurality of sensors disposed about a periphery of the loading equipment, each sensor being operable to generate a proximity signal in response to detecting an object within a coverage region of the sensor, the proximity signal including an indication of at least an approximate distance between the sensor and the object. The method further involves processing the proximity signals to determine a location of the object relative to the loading equipment, and initiating an alert when the location falls within the alert region.

A plurality of detection zones may be defined for each sensor, the detection zones extending outwardly from the sensor and receiving the proximity signals may involve receiving a proximity signal including information identifying one of the detection zones within which the object may be located.

Defining the alert region may involve, for each sensor, associating ones of the plurality of detection zones with the alert region.

Defining the alert region may involve associating a coverage region of each sensor with a positioning of the sensor on the periphery of the loading equipment and processing the proximity signals may involve determining an intersection between the coverage region and the operating ambit of the loading equipment.

Determining the intersection may involve determining an intersection between the coverage region and a collision path portion of the operating ambit of the operating equipment.

Defining the alert region may involve receiving positioning information defining a positioning of each sensor on the periphery of the loading equipment.

Swinging movements of the loading equipment during loading operations may occur about a pivot and the method may further involve receiving information defining a location of the pivot and a location of the extents of the loading equipment.

Adjacently disposed sensors on the periphery of the loading equipment may each have at least one detection zone that overlaps with a detection zone of the adjacently disposed sensor and processing the proximity signals may involve combining the information identifying respective detection zones associated with the adjacently disposed sensors to determine the location of the object.

Swinging movements of the loading equipment during loading operations may occur about a pivot and defining the alert region may involve defining a region extending outwardly from the pivot.

Defining the region extending outwardly from the pivot may involve defining a generally cylindrical sector having a radius dimension corresponding to a distance between the pivot and an outermost extent of the outer extents.

Defining the alert region may involve defining at least one of a collision region, where objects located within the collision region would be disposed in a collision path of the operating equipment, and defining a warning region extending outwardly from the collision region, where objects located within the warning region are outside of the collision region but sufficiently close to the collision region to be in danger of encroaching on the collision region.

Swinging movements of the loading equipment during loading operations may occur about a pivot and defining the collision region may involve defining a generally cylindrical sector having a radius dimension corresponding to a distance between the pivot and an outermost extent of the outer extents.

Defining the warning region may involve defining a generally hollow cylinder shaped sector extending outwardly from the collision region.

The method may involve determining a pattern of movement between an object within the warning zone with respect to the loading equipment, determining whether the pattern of movement corresponds to a pattern of movement associated with normal operations of the loading equipment, and initiating the alert may involve issuing an alert only when the pattern of movement does not correspond to a pattern of movement associated with normal operations of the loading equipment.

Swinging movements of the loading equipment during loading operations may occur about a pivot and determining whether the pattern of movement of the object corresponds to normal operations of the loading equipment may involve determining whether movement of the object generally corresponds to a movement about the pivot.

The method may involve recording location information associated with objects that enter the operating ambit of the loading equipment to facilitate analysis of loading operations.

The loading equipment may include at least one camera disposed to capture images of at least a portion of the operating ambit and initiating the alert may involve causing a view of the at least the portion of the operating ambit to be displayed on a display for viewing by an operator of the loading equipment when the object may be located within a field of view of the at least one camera.

The loading equipment may include a plurality of cameras disposed to capture images of respective portions of the operating ambit and initiating the alert may involve selectively displaying a view captured by a camera of the plurality of cameras that is best disposed to provide a view of the object.

Initiating the alert may involve at least one of causing an audible tone to be produced for warning an operator of the loading equipment, causing an audible tone to be produced for warning an operator of the object, causing a visual alert to be displayed on a display associated with operations of the loading equipment, causing a warning light within view of the operator to be activated, generating a wireless alert signal for receipt by other equipment located in the vicinity of the operating ambit of the loading equipment, and generating a wireless alert signal for receipt by a dispatch center, the dispatch center being in communication with at least one of an operator of the loading equipment and an operator of the object.

The loading equipment may include at least one outwardly directed warning light for providing a warning to an object entering the operating ambit of the loading equipment and initiating the alert may involve activating the at least one warning light.

The loading equipment may include a plurality of outwardly directed warning lights disposed about the periphery of the loading equipment and initiating the alert may involve selectively activating one of the plurality of warning lights that may be disposed to provide a visual alert to an operator of the object.

The method may involve determining an object type associated with the object and may further involve generating a signal operable to halt operation of at least one of the object and the loading equipment when the location falls within the alert region.

Determining the object type may involve at least one of performing image analysis on an image of the object captured by a camera disposed to capture images of at least a portion of the operating ambit within which the object is located, reading a radio frequency identification associated with the object, and processing the proximity signals produced by the sensors, the sensors being further operably configured to provide information indicative of a shape of detected objects within a coverage region of the sensor.

The loading equipment may include an electric mining shovel and a hydraulic mining shovel.

The outer extents may include a counterweight of the mining shovel.

The sensor may include a radar object detection sensor.

The method may involve using the processed proximity signals to generate statistical data representing a number of detections within a coverage region of a sensor.

The method may involve generating a map representing the number of detections within the coverage region of each of the plurality of sensors.

In accordance with another aspect of the invention there is provided a system for generating an indication of an object within an operating ambit of heavy loading equipment. The system includes a plurality of sensors disposed about a periphery of the loading equipment, each sensor being operable to generate a proximity signal in response to detecting an object within a coverage region of the sensor, the proximity signal including an indication of at least an approximate distance between the sensor and the object. The system also includes a processor circuit operably configured to define an alert region extending outwardly from the loading equipment and encompassing swinging movements of outer extents of the loading equipment during operation. The processor circuit is also operably configured to receive proximity signals from the plurality of sensors, process the proximity signals to determine a location of the object relative to the loading equipment, and initiate an alert when the location falls within the alert region.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

Figure 1:
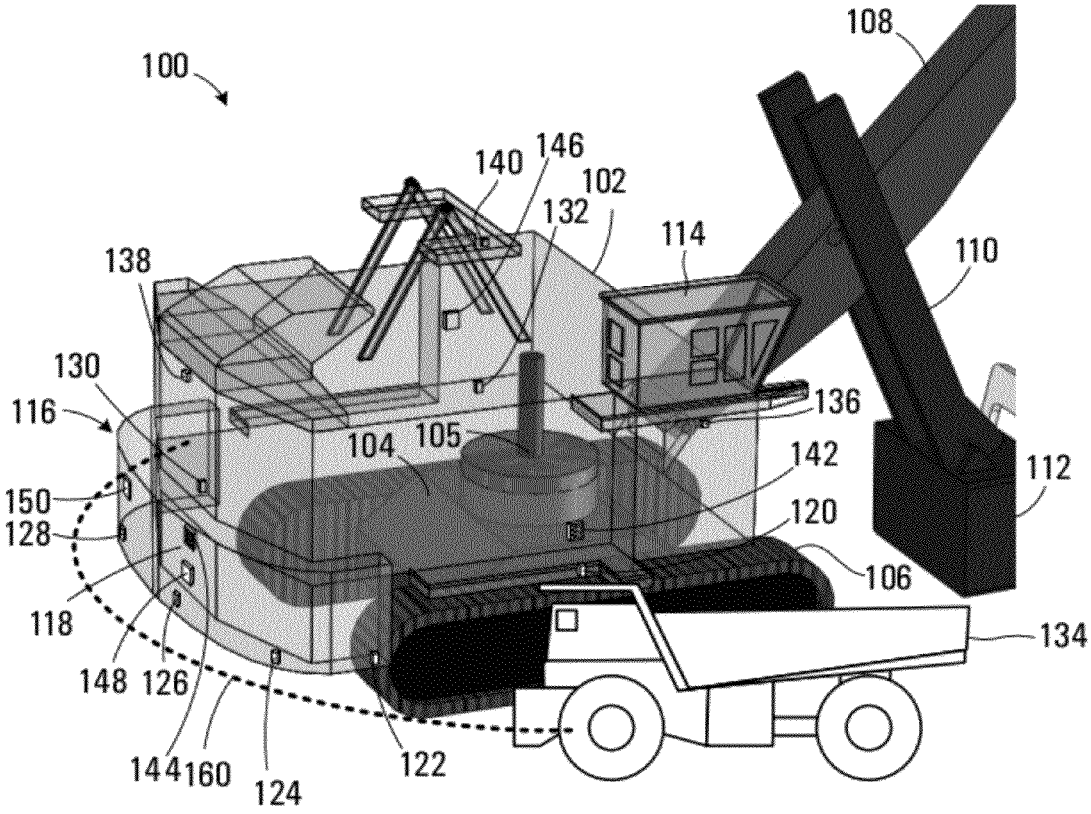
FIG. 1 is a perspective view of a mining shovel and a collision avoidance system in accordance with a first embodiment of the invention.

Referring to FIG. 1, an electric mining shovel is shown generally at 100. The shovel 100 includes a machinery housing 102 that is pivotably mounted on a crawler platform 104 at a pivot 105. The crawler platform includes crawler tracks 106 for moving the shovel 100 to a loading location. The shovel 100 also includes a boom 108 extending outwardly form the housing 102, which supports a dipper handle 110 and a dipper 112. The machinery housing 102 encloses various motors and other equipment (not shown) for operating the shovel 100 and also includes a cabin structure 114 that is equipped with various operating controls for use by an operator of the shovel. In the embodiment shown in FIG. 1, the housing 102 of the shovel 100 further includes a rearwardly protruding portion 116 that supports a counterweight 118.

During loading operations the dipper 112 and dipper handle 110 are operated to load ore into the dipper and the housing 102 is swung through an arc about the pivot 105 to deposit the ore into a waiting haul truck or other payload transport means. The arc through which the housing 102 swings during operations defines an operating ambit of the shovel 100 within which objects may be subject to collision with various portions of the shovel 100. The cabin structure 114 is disposed on the housing so as to provide the operator with a view of the dipper handle 110 and dipper 112. However other portions of the shovel 100 such as the rearwardly protruding portion 116 and counterweight 118 are generally located outside the operator's field of view. Accordingly, while objects within the operating ambit of the shovel 100 in the path of the dipper may be visible to the operator, objects located in the path of other portions of the shovel, such as the counterweight 118, would generally not be visible to the operator.

The shovel 100 includes a system according to a first embodiment of the invention for generating an indication of an object within an operating ambit of the shovel. The system includes a plurality of proximity sensors 120, 122, 124, 126, 128, 130, and 132 disposed about a periphery of the housing 102 of the shovel. In one embodiment the sensors 120-132 are Xtreme PreView™ radar sensors provided by Preco Electronics of Boise, Id., USA. The Xtreme PreView sensor utilizes pulse radar technology to detect moving and stationary objects. Each of the sensors 120-130 is operable to generate a proximity signal in response to detecting an object 134 (such as a haul truck or other mining equipment) within a coverage region of the sensor. In general the sensors 120-130 have a three dimensional (3D) coverage region that extends outwardly from the sensor in 3D space. The proximity signal includes an indication of at least an approximate distance between the sensor 120-132 and the object 134. In other embodiments the sensors 120-132 may comprise sensors that employ ultrasonics or lasers to generate proximity signals. In other embodiments, the sensors could be replaced or complemented by GPS coordinates of the equipment if available.

In the embodiment shown the system also includes a plurality of cameras 136, 138, and 140 disposed to capture images of portions of the operating ambit of the shovel. The system of the embodiment shown further includes a plurality of warning lights 142, 144, 146, and a plurality of audible warning generators 148, and 150. The warning lights 142-146 and audible warning generators may be disposed in convenient locations on the housing 102, not necessarily proximate to the sensors (for example, left, rear and right sides of the housing). In one embodiment the warning light may be implemented using a light emitting diode (LED) module having a plurality of bright LED elements. Ruggedized LED modules having 2 banks of LED's are available for such applications and have the advantage of high luminous output while consuming only about 50 W of power when activated.

Figure 2:
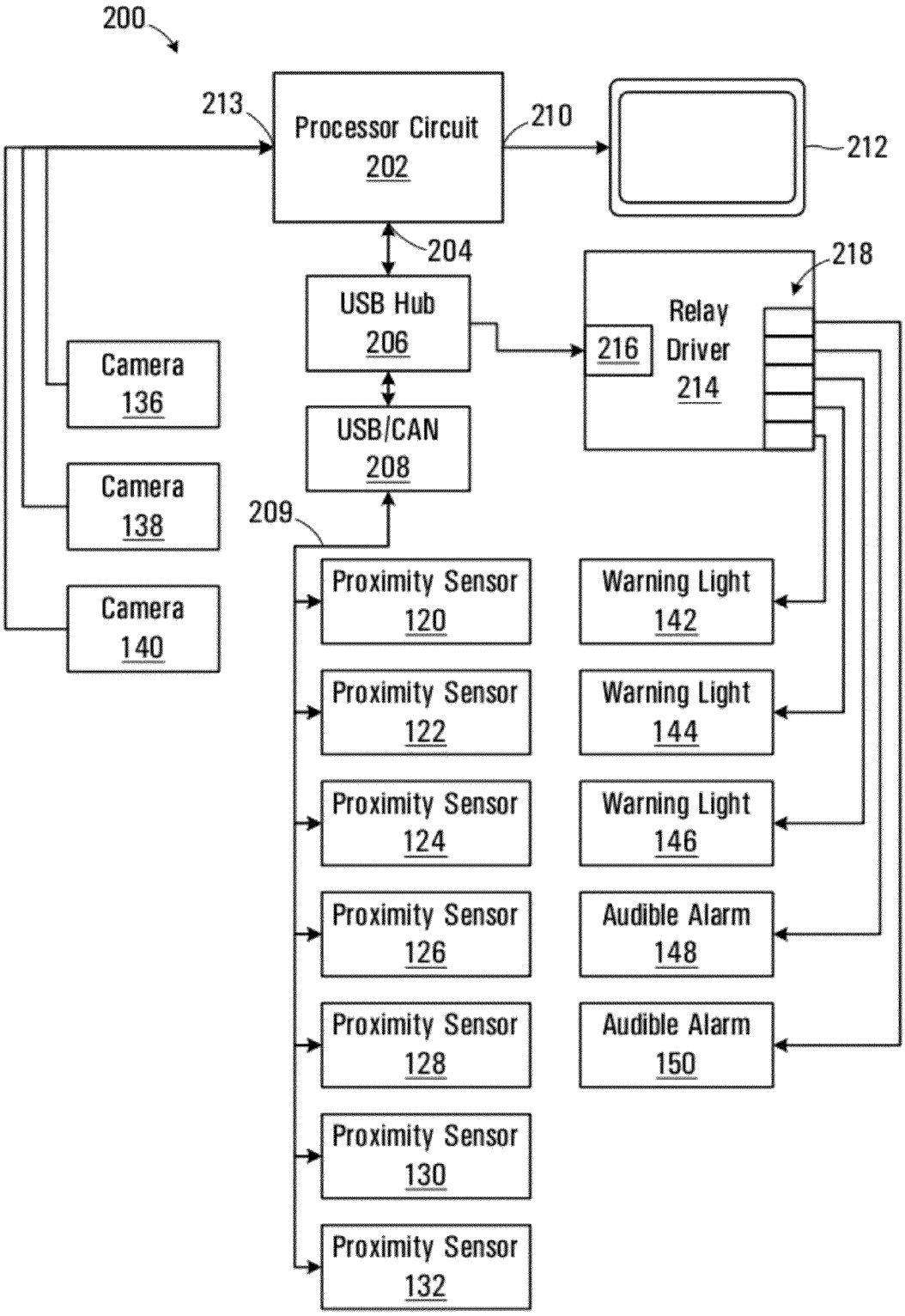
FIG. 2 is a block diagram of the collision avoidance system shown in FIG. 1.

Referring to FIG. 2, a block diagram of the system for generating an indication of an object within an operating ambit of the shovel is shown generally at 200. The system 200 includes a processor circuit 202, which is operably configured to define an alert region. Referring back to FIG. 1, the alert region in this embodiment is represented by a broken line 160 extending outwardly from the shovel 100 and the alert region encompasses swinging movements of outer extents of the shovel (such as the rearwardly protruding portion 116 and/or counterweight 118) occurring during operation. In one embodiment swinging movements of the shovel may be confirmed by doing image analysis on the camera outputs.

The processor circuit 202 includes a port 204 for receiving proximity signals from the plurality of sensors 120-132. In the embodiment shown, the port 204 is a universal serial bus port (USB), which is in communication with a remotely located USB hub 206 that expands the single USB port into several USB ports for controlling more than one hardware element. The system 200 also includes a USB to controller-area network bus (CAN) interface 208. In the embodiment shown the sensors 120-132 are connected via a CAN bus 209 and the USB/CAN interface 208 functions to convert CAN signals transmitted over the CAN bus into signals suitable for receipt by the USB hub 206, which is in turn in communication with the port 204 for transmitting the proximity signals from the sensors 120-132 to the processor circuit 202. The USB/CAN interface 208 also facilitates transmission of commands from the processor circuit 202, via the USB hub 206 and USB/CAN interface, to the sensors for configuring the sensors, if necessary. The CAN bus is a bus interface developed for vehicle sensor systems that facilitates communication with sensors within a vehicle and provides for communication between the processor circuit 202 and the sensors 120-132. Suitable USB/CAN interfaces are available from PEAK-System Technik GmbH, of Darmstadt, Germany. In other embodiments sensors having data communication implementations other than the CAN bus 209 may equally well be used in the system 200. Other examples of bus-based communication that may be employed would be RS-422, RS-485, Profibus, or Ethernet-based communications. Point-to-point communication protocols such as RS-232, RS-422, Profinet may also be used.

The processor circuit 202 further includes an output 210 for generating display signals for driving a display 212, such as an LCD panel display. In one embodiment, the LCD display 212 comprises a touch screen LCD display that also facilitates receiving input from the operator. In the embodiment shown, the processor circuit 202 further includes an input 213 for receiving image signals from the cameras 136-140.

The system 200 further includes a relay driver 214 for activating the warning lights and audible warning generators 142-150. The relay driver 214 includes a USB interface 216 for receiving control signals and a relay bank 218 having a relay for activating each respective warning light or audible warning generator 142-150. The relay driver 214 is operable to selectively activate one or more of the warning lights and/or audible warning generators 142-150 in response to commands from the processor circuit 202 received via the USB hub 206.

Figure 3:
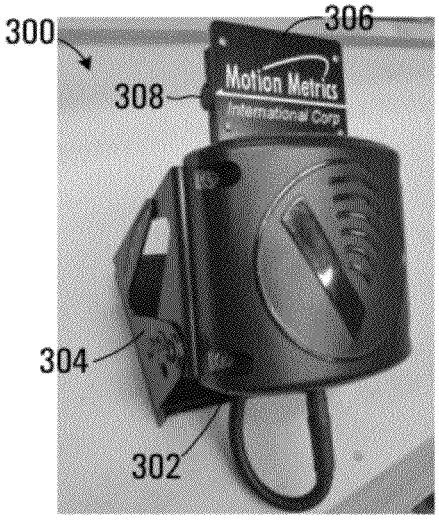
FIG. 3 is a perspective view of a sensor used in the collision avoidance system shown in FIG. 1.

Referring to FIG. 3, an exemplary sensor assembly is shown generally at 300. The sensor assembly 300 includes the Xtreme PreView proximity sensor element 302, which is mounted on a bracket 304 that permits the sensor to be tilted to aim the coverage region of the sensor to cover a desired portion of the operating ambit of the shovel 100. The assembly also includes a junction box 306 that has a CAN connector input 308 and an additional CAN connector output (not visible in FIG. 3). The CAN bus cabling that is connected to the connector input 308 may also carry power supply lines for powering the sensor element 302. The additional CAN connector output facilitates connection to a further sensor assembly. The CAN bus 209 runs through the junction box 306 between the CAN connector input 308 and the output, with the sensor element 302 connecting to the CAN bus lines within the junction box 306. Advantageously, the junction box 306 permits the sensors 120-132 to be serially chained and different numbers of installed sensors are easily accommodated depending on the particular loading equipment that is being equipped. A final sensor on the CAN bus 209 would have a bus terminator coupled to the output of the junction to properly terminate the CAN bus.

In general, the display 212 would be located within the cabin structure 114 and the processor circuit 202 may be disposed in or proximate to the cabin. The USB hub 206 and USB/CAN interface 208 may be located proximate the processor circuit 202, the CAN bus 209 extending to the first sensor (for example sensor 120 shown in FIG. 1) and then to each successive sensor 122-132.

Figure 4:
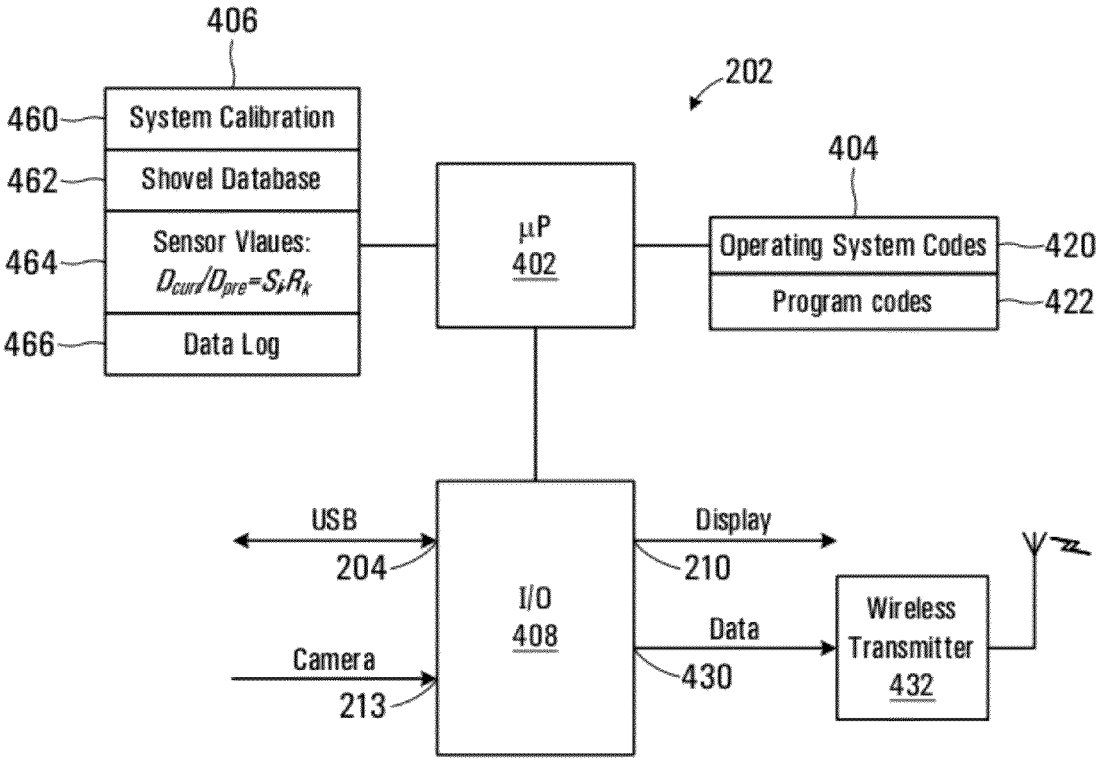
FIG. 4 is a block diagram of a processor circuit of the system shown in FIG. 1 and FIG. 2.

The processor circuit 202 is shown in greater detail in FIG. 4. Referring to FIG. 4, the processor circuit 202 includes a microprocessor 402, a program memory 404, a variable memory 406, and an input output port (I/O) 408, all of which are in communication with the microprocessor 402.

The I/O 408 includes the USB port 204 and the image input port 213 for receiving image signals from the camera 136-140. The I/O 408 further includes the output 210 for producing display signals for driving the display 212. Optionally, the I/O 408 may also include an output 430 for connecting to a wireless transmitter 432. The wireless transmitter 432 may be configured to transmit indications associated with detection of objects within the operating ambit of the shovel 100, as described later herein.

Program codes for directing the microprocessor 402 to carry out various functions are stored in the program memory 404, which may be implemented as a random access memory (RAM) and/or a persistent storage medium such as a hard disk drive or solid state memory, or a combination thereof. In the embodiment shown, the program codes may be loaded into the program memory 404 via the USB port 204, while in other embodiments program codes may be loaded into the processor circuit 202 using any number of known techniques. The program memory includes a first block of program codes 420 for directing the microprocessor 402 to perform operating system functions. In one embodiment the program codes 420 may implement the Windows Embedded operating system, produced by Microsoft Corporation of Redmond, Wash., USA. The program memory 404 also includes a second block of program codes 422 for directing the microprocessor 402 to perform functions associated with generating the indications of objects within an operating ambit of the shovel 100.

The variable memory 406 includes a plurality of storage locations including a store 460 for storing system calibration values, a store 462 for storing data for different mining shovel configurations, a store 464 for storing sensor values associated with objects being tracked, and a store 466 for storing a data log. The variable memory 406 may be implemented in random access memory, for example.

System Calibration

Figure 5:
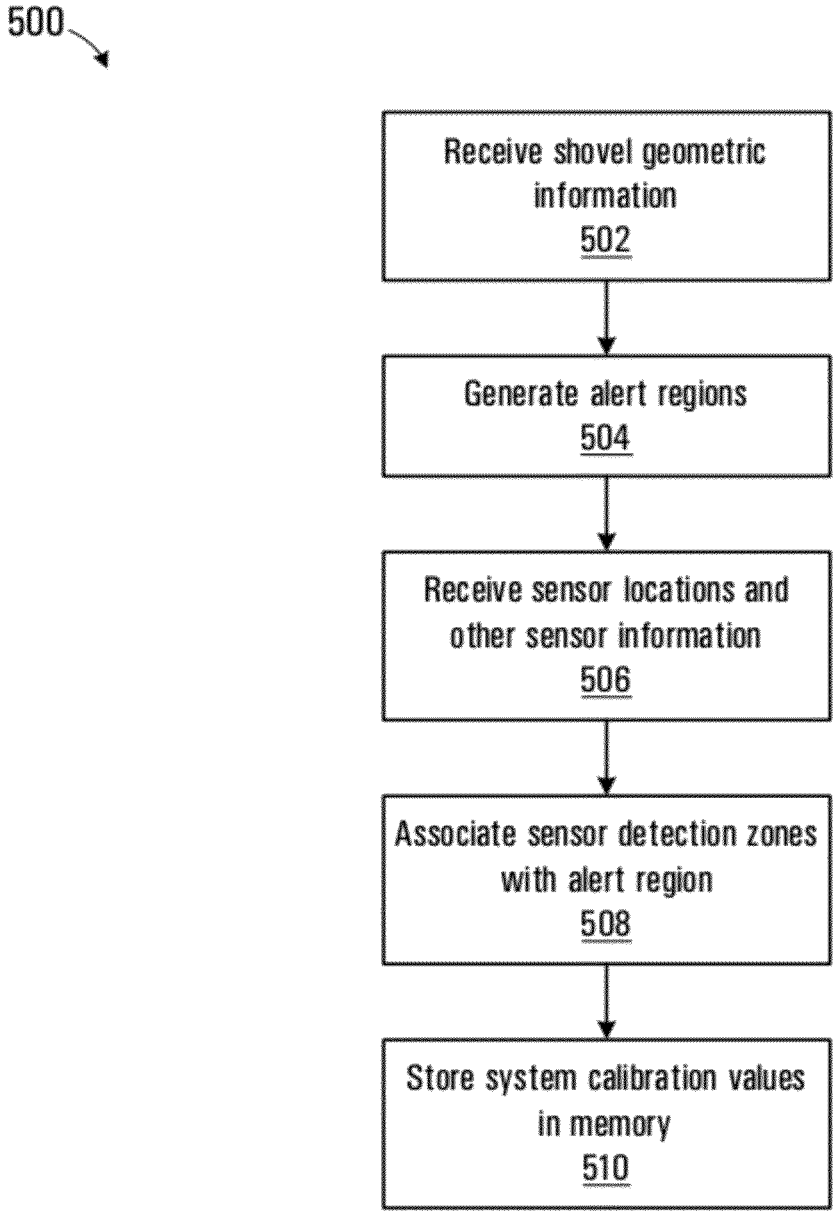
FIG. 5 is a process flowchart including blocks of codes for directing the processor circuit of FIG. 4 to implement system calibration functions.

Referring to FIG. 5, a flowchart depicting blocks of code for directing the processor circuit 202 to perform a system calibration is shown generally at 500. The blocks generally represent codes that may be read from the program memory 422, for directing the microprocessor 402 to perform various functions related to performing the calibration. The actual code to implement each block may be written in any suitable program language, such as C, C++ and/or assembly code, for example. System calibration is generally performed at installation and updates the system calibration values stored in the store 460 of the variable memory 406 shown in FIG. 4 based on the actual installation locations of the sensors and the geometry of the shovel.

Figure 6:
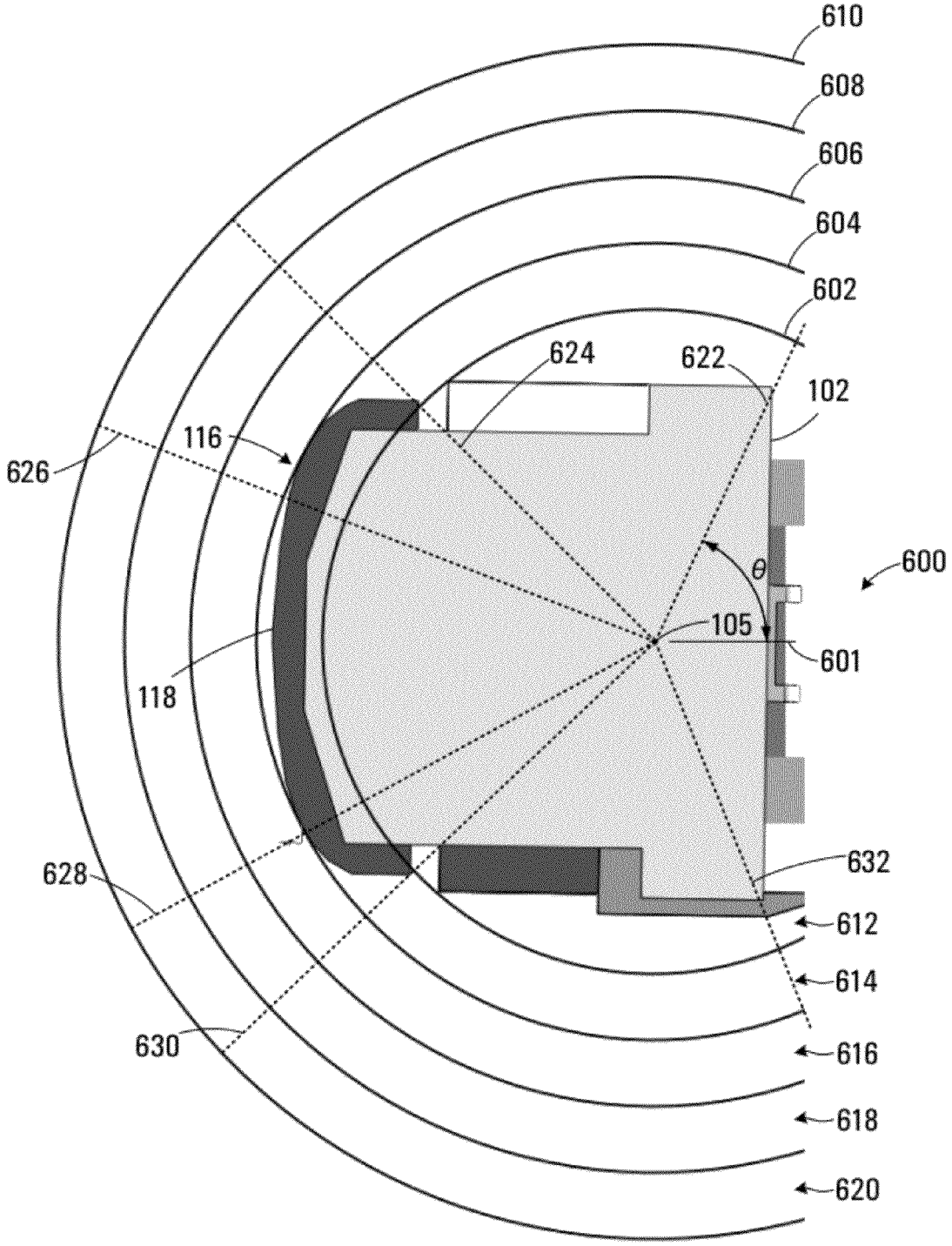
FIG. 6 is a plan view of a shovel outline image representation stored in a memory of the processor circuit of FIG. 4.

The process 500 starts at block 502, which directs the microprocessor 402 to receive, shovel geometric information defining the geometry of the shovel 100 and to store the geometric information in the store 460 of the variable memory 406. In the processor circuit embodiment shown in FIG. 4, bitmap images and associated data for a variety of different mining shovels are stored in the shovel database store 462 of the variable memory 406 and receiving the geometric information involves locating and reading data in the database store 462 associated with a selected shovel model. For example, a listing of shovels may be displayed by manufacturer and model number on the display 212 for selection by the installer of the system 200. In one embodiment, the database store 462 also stores a scaled plan view image of the shovel as a bitmap plan image. Referring to FIG. 6, an exemplary image is shown at 600. The image 600 includes an outline representation of the housing 102, rearwardly protruding portion 116, and counterweight 118. In one embodiment, the database store 462 also stores an associated data file for each image 600, which may be an Microsoft Excel data file including values associated with the image that define attributes such as a scale factor for the, a location of the pivot 105 or center of rotation of the shovel, and identifications of surfaces of the housing 102 on which the sensors are expected to be installed.

The process 500 continues at block 504, which directs the microprocessor 402 to generate the alert regions for the shovel 100. Referring to FIG. 6, the image 600 includes a plurality of circular arcs 602, 604, 606, 608, and 610, each centered at the pivot 105. The arcs 602-610 define a respective plurality of cylindrical alert regions 612, 614, 616, 618, and 620, as described above. In the embodiment shown in FIG. 6, the alert region 612 is defined within the arc 602 and represents a region within which an object would be in the collision path of left and right sides of the shovel 100. The alert region 614 is defined between the arc 602 and the arc 604 and represents a region within which an object would be in the collision path of the counterweight 118. As such regions 612 and 614 each represent collision alert regions within which an object would be subject to collision by parts of the shovel 100 if the shovel were to swing during loading operations.

Additional alert regions 616-620 may also be defined between successive arcs 604, 606, 608, 610. These alert regions 616-620 may be defined as warning alert regions for facilitating initiation of warnings to the shovel operator or operators of an object when entering portions of the operating ambit of the shovel that are proximate to collision regions. In one embodiment, the data file stored in the database store 462 that is associated with the image 600 may include standard radii for the arcs 602-610 that define the respective alert regions 612-620 with respect to the pivot 105.

Block 504 may further direct the microprocessor 402 to define circular sector portions that divide each alert region 612-620 into a plurality of annular segments, each annular segment representing a generally hollow cylinder shaped sector. For example, radial lines 622 and 624 extending outwardly from the pivot 105 may be used to designate a left side of the shovel 100. Similarly, lines 624 and 626 may be included to designate a left rear side of the shovel, lines 626 and 628 may be included to designate a rear of the shovel, lines 628 and 630 may be included to designate a right rear side of the shovel, and lines 630 and 632 may be included to designate a right side of the shovel. The lines 622-632 may each be defined by respective angles θ to a reference x-axis 601 passing through the pivot 105. The process 500 may include a further step of associating respective portions of the housing 102 indicated by the lines 622-632 with specific sensors.

The process 500 then continues at block 506, which directs the microprocessor 402 to receive input of sensor locations and information. For installation of the system 200 on existing shovels in the field, it may not be possible to always install each of the sensors 120-132 in an exact pre-determined location on the housing 102, and accordingly the system calibration process 500 accounts for this variation by receiving input of the locations of the sensors from the system installer. In one embodiment, the image 600 may be displayed on the display 212 and the installer may be prompted to indicate each sensor location along a periphery of the shovel outline by touching the screen of the display 212 to indicate an approximate location of the respective sensors. In one embodiment, the data file stored in the database store 462 that is associated with the image 600 may include coordinates of suitable installation surfaces of the housing 102 of the shovel 100 for locating sensors, and the installer input may be combined with such coordinates to determine a coordinate location of the sensor on the image. The suitable installation surfaces may each be defined by start point coordinates and end point coordinates in a coordinate system centered at the pivot 105 and having a positive x-axis as shown at 601 and a positive y-axis extending along the boom 108 of the shovel 100. Coordinate information for each installation surface may be saved together with orientation information that defines an orientation of the surface with respect to the housing 102 for defining the orientation of sensors mounted on the installation surface. As each sensor location is entered, the installer may also be prompted to enter other information concerning the sensor, such as the type or coverage region of the sensor. For a large shovel 100, indicating the sensor location with a precision of ±0.5 m may be sufficient to provide acceptable performance of the system 200.

Figure 7:
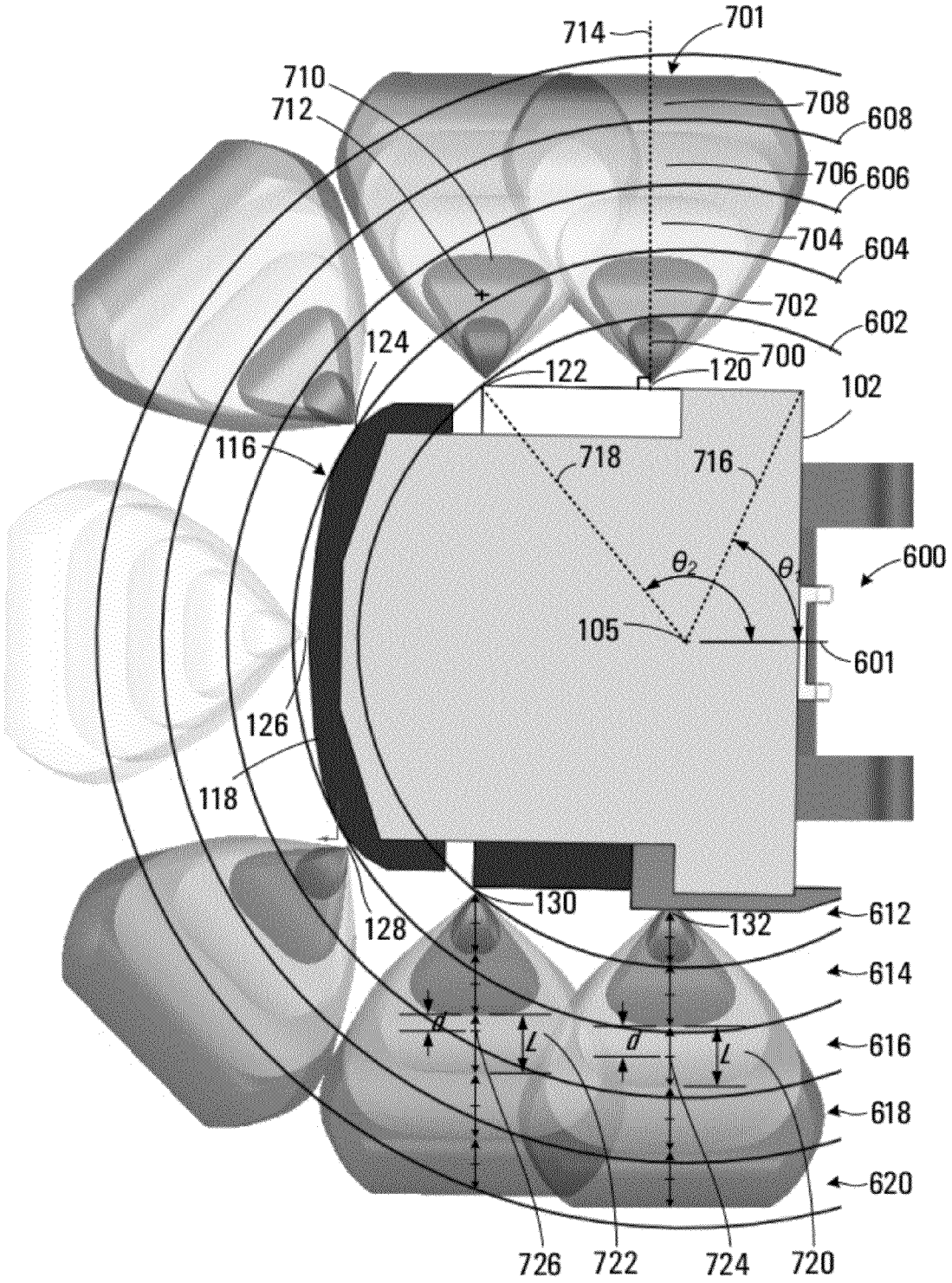
FIG. 7 is a further plan view representation of a shovel outline stored in a memory of the processor circuit of FIG. 4.

Block 508 then directs the microprocessor 402 to associate detection zones of each of the sensors 120-132 with the alert regions. Referring to FIG. 7, the image 600 of FIG. 6 is shown with a plurality of sensor detection zones for each of the sensors 120-132 super-imposed on the alert regions 612-620. In this embodiment, the coverage regions associated with sensors 120 and 122 (and sensors 130 and 132) partially overlap, and accordingly, objects may be simultaneously detected by more than one sensor. In this case, an object location may be determined based on an aggregation of the sensor detection zone indications provided by the adjacently located sensors. In the embodiment shown, each sensor 120-132 has the same coverage region, however in other embodiments sensors with different coverage regions may be used in different locations.

For the exemplary Xtreme PreView radar sensor 120, a coverage region 701 of the sensor is divided into five detection zones 700 to 708, represented by the shaded regions shown in FIG. 7. The installation surface for the sensor 120 is defined between lines 716 and 718 at respective angles $\theta_1$ and $\theta_2$. The sensor coverage region 701 in the image 600 is aligned with a line 714 that extends outwardly normal to the installation surface. The angle of the installation surface for each sensor may be pre-determined and saved in the database store 462 to permit simple alignment of the coverage region 701 during system installation.

The sensor 120 is configured to process signals such that when an object is detected by the sensor, the sensor resolves the location of the object to a single detection zone and outputs an identification on the CAN bus 209 (shown in FIG. 2) of the detection zone along with the sensor identifier sensor. Block 508 thus directs the microprocessor 402 to examine the detection zones of each of the sensors 120-132 and to determine which of the alert regions 612-620 the each detection zone falls within. The determination may be made by determining a radial distance between a center of the detection zone and the pivot 105. Since the arcs 602-610 are also defined on the basis of the radial distance from the pivot 105, the detection zones 700 to 708 can be simply mapped to the alert regions 612-620 on this basis. For example, since the detection zone 702 largely falls between circular arcs 602 and 604, the detection zone 702 may be mapped to the alert region 614. Similarly the detection region 702 is mapped to the alert region 616.

In one embodiment the sensor detection zones 700-708 each have an outward extent L as indicated. A center of association for each sensor detection zone lies at a distance "d" from a previous sensor region and is generally centered with respect to the outward extent L of the sensor detection zone. For example, the sensor detection zone 720 is associated with the alert region 616 of the shovel 100 since its center of association 724 falls within the alert region 616. Similarly, the sensor detection zone 722 is also associated with the alert region 616 of the shovel 100 since its center of association 726 falls within the alert region 616. A ratio of d/L may be computed to indicate how conservative the association is. For any of the sensor detection zones 700-708, a low ratio of d/L indicates a tendency to associate outwardly located sensor detection zones to the alert regions 612-620, while a ratio d/L that is close to unity would indicate a tendency to associate sensor zones that are closer to the shovel with the alert regions. In FIG. 7, the sensor detection zone 722 is shown having a conservative (small) ratio d/L. This conservative mapping of detection zones to alert regions would reduce the possibility of incorrectly locating an object in a warning zone, when in fact the object is at least partially within a collision zone, thus providing an operational safety factor for the system 200.

The process 500 shown in FIG. 5 then continues at block 510, which directs the microprocessor 402 to store the system calibration values in the store 460 of the variable memory 406 (shown in FIG. 4).

In embodiments that include cameras such as the cameras 136-140 shown in FIG. 2, the process 500 may additionally include a block of codes that directs the microprocessor 402 to receive an input of locations of the cameras, and that further directs the microprocessor to associated the cameras with portions of the housing 102 (for example a left or right side or rear).

Operation

Figure 8:
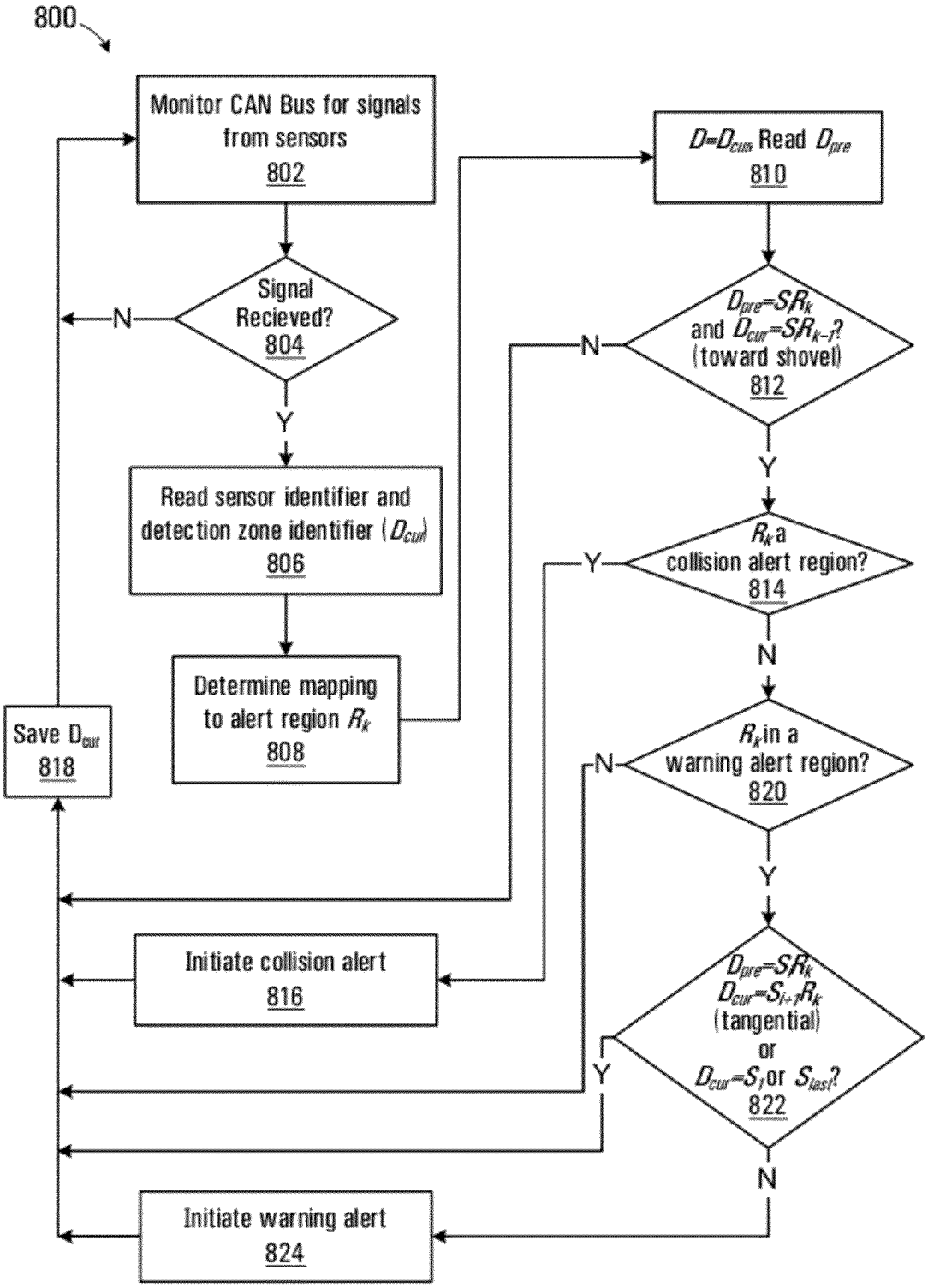
FIG. 8 is a process flowchart including blocks of codes for directing the processor circuit of FIG. 4 to implement operating functions for generating indications of objects within the operating ambit of the shovel shown in FIG. 1.

Referring to FIG. 8, a flowchart depicting blocks of code for directing the processor circuit 402 to generate indications of objects within the operating ambit of the shovel 100 is shown generally at 800. The process 800 is only initiated after the system calibration process 500 has been completed and the system calibration values are stored in the store 460 of variable memory 406.

Block 802 of the process 800 directs the microprocessor 402 to monitor the CAN bus 209 (shown in FIG. 2) for signals from the sensors 120-132 that are connected to the bus. When one of the sensors 120-132 detects an object in one of the detection zones of the sensor, the sensor transmits a message identifying the detection zone on the CAN bus 209. Under the CAN bus protocol the message will include the sensor identifier and message transmission is automatically arbitrated in accordance with the sensor identifier. Accordingly, if any of the sensors 120-132 are deemed to be higher priority for monitoring than other sensors, the sensor identifier may be allocated accordingly to give messages from that sensor priority.

If at block 804, no sensor signal is received on the CAN bus 209, block 804 directs the microprocessor 402 back to block 802, which is repeated. If at block 804, a sensor signal is received on the CAN bus 209, block 804 directs the microprocessor 402 to block 806, which directs the microprocessor to read the sensor identifier that transmitted the message and to read the detection zone identifier $D_{cur}$ included in the message.

The process 800 then continues at block 808, which directs the microprocessor 402 to map the sensor detection zone to the alert region $R_k$ as described above in connection with the system calibration.

Block 810 then directs the microprocessor 402 to read the previous $D_{curr}$ sensor detection value from the store 464 and to set the value to $D_{pre}$, as the previous sensor detection value for the object. Block 810 also directs the microprocessor 402 to store the sensor identifier and new detection zone identifier in the sensor value store 464 as the current detection value $D_{cur}$ for the object.

The process then continues at block 812, which directs the microprocessor 402 to read the values of $D_{pre}$ and $D_{cur}$ and to determine whether the object has moved toward the shovel, which would be indicated by the alert zone R changing from an outer alert zone $R_k$ to an inner alert zone $R_{k-1}$. If at block 812 the object has moved toward the shovel, then block 812 directs the microprocessor 402 to block 814 which directs the microprocessor 402 to determine whether $R_k$ is a collision alert region, in which case the process continues at block 816.

Block 816 directs the microprocessor 402 to cause a collision alert to be issued. In the event of an object appearing within a collision alert region, there is no need for further processing and a collision alert may be issued immediately to provide the operator with sufficient time to avoid any associated danger. Block 816 then directs the microprocessor 402 to block 818, which directs the microprocessor 402 to store the sensor identifier and associated detection zone identifier in the sensor value store 464 of the variable memory 406 as a current detection value $D_{cur}$ for the object. Block 818 then directs the microprocessor 402 back to block 802 and blocks 802-810 of the process 800 are repeated.

If at block 812 the object has not moved toward the shovel, then block 812 directs the microprocessor 402 to block 818, which directs the microprocessor 402 to store the sensor identifier and associated detection zone identifier and directs the microprocessor 402 back to block 802 as described above.

If at block 814, $R_k$ is not a collision alert region, then block 814 directs the microprocessor 402 to block 820. Block 820 directs the microprocessor 402 to determine whether $R_k$ is identified as a warning region. If $R_k$ is not identified as a warning region then block 820 directs the microprocessor 402 to block 818, which directs the microprocessor 402 to store the sensor identifier and associated detection zone identifier and directs the microprocessor 402 back to block 802 as described above.

If at block 820 $R_k$ is identified as a warning region then block 820 directs the microprocessor 402 to block 826, which directs the microprocessor 402 to block 822. Block 822 directs the microprocessor 402 to determine whether the object has moved tangentially with respect to the shovel, which would be indicated by the sensor $S_i$ changing to an adjacent sensor $S_{i\pm1}$ while the alert zone R remains $R_k$. If at block 822 the object has not moved tangentially, the microprocessor 402 is directed to block 818, which directs the microprocessor 402 to store the sensor identifier and associated detection zone identifier and directs the microprocessor 402 back to block 802 as described above.

Advantageously, by detecting tangential movement of an object through the same alert zone, warnings that would occur due to normal loading operations involving, for example, a haul truck at the side of the shovel 100 would be avoided. By not triggering a warning for objects that the operator is aware of, other warnings that are higher priority will be more apparent to the operator.

If however at block 822, the object has not moved tangentially with respect to the shovel, then block 822 directs the microprocessor 402 to block 824, which directs the microprocessor 402 to initiate a warning alert. Block 824 then directs the microprocessor 402 back to block 818, which directs the microprocessor 402 to store the sensor identifier and associated detection zone identifier and directs the microprocessor 402 back to block 802 as described above.

Block 822 also directs the microprocessor 402 to determine whether the read the detection zone identifier $D_{cur}$ corresponds to either the first or last sensors which would indicate that the object has moved tangentially into the alert region $S_1$ or $S_{last}$, in which case it would not be possible to detect tangential movement of the object. In this case block 822 would direct the microprocessor 402 back to block 818, to store the sensor identifier and associated detection zone identifier and direct the microprocessor 402 back to block 802 as described above.

Figure 9:
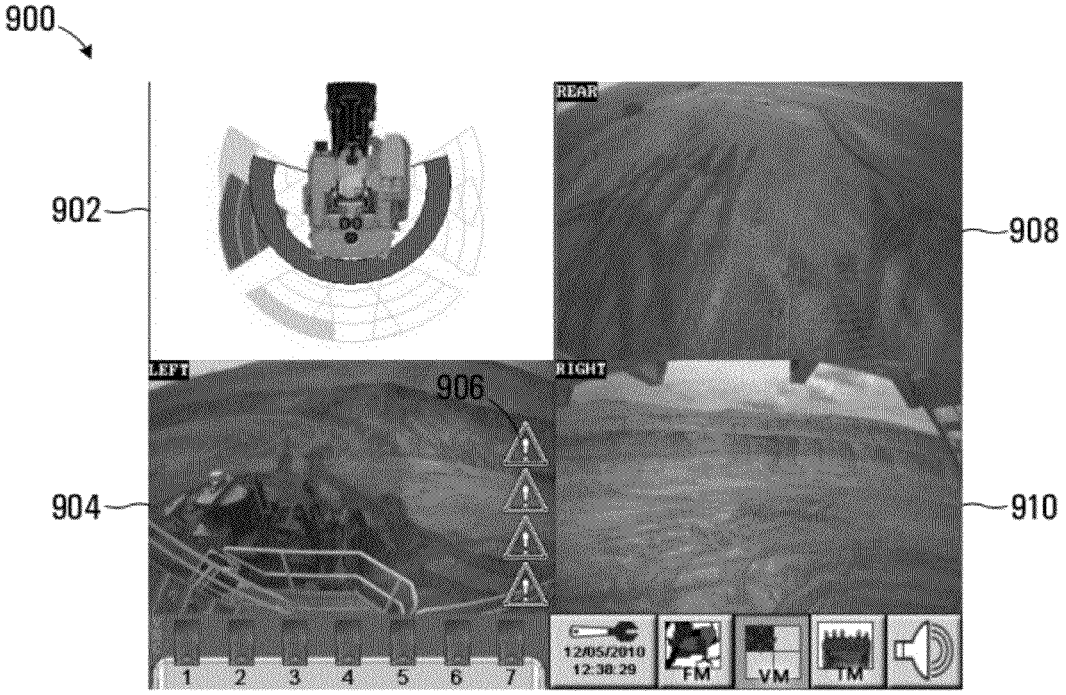
FIG. 9 is a screenshot of a warning screen generated by the system shown in FIG. 2.

Referring to FIG. 9, a display screen representation that may be produced by the system 200 is shown generally at 900. The display includes a plan-view image representation 902 of the shovel and operating ambit. The image 902 is generally similar to the image 600 shown in FIG. 7. In the image 902 the presence of an object is indicated by displaying an alert zone within which the object is located in a color (In this case brown) to provide the operator with information on the object location. As the object moves closer the alert zone color may be shown as yellow or red to indicate escalating danger. In the embodiment shown, the activated sensor or sensors are also shown in color to indicate which sensors are being activated by the object. Other processing may cause sensors that are not operating properly to be shown in another color to alert the operator to the failure status of the collision avoidance system. The system 200 shown in FIG. 2 may also cause audible or visual alert within the cabin structure 114 to be activated to warn the operator.

In systems such as the system 200 shown in FIG. 2 that include cameras 136-140, camera views may be selectively activated or otherwise selectively changed to warn the operator. For example, the displayed screen 900 may include a Left camera view 904, a rear camera view 908, and a Right camera view 910, displayed on the display 212 during operation of the shovel 100. In the embodiment shown in FIG. 9, a grader object is located in the left view 904, and several warning indicia 906 are displayed on the view to draw the operator's attention to the view. The other views 908 and 910 are clear and no warning indicia are displayed. Various other operator warning schemes may be implemented, as desired.

When block 812 initiates a collision alert or block 824 initiates a warning alert, the system 200 shown in FIG. 2 may also cause one or more alerts to be issued to an operator of the detected object. For example, block 824 may cause one of the warning lights 142-146 or audible warning generators 148, 150 that is in the general vicinity of a particular one of the sensors 120-132 to be activated to provide an initial warning to an operator of the object. If the object continues to move toward the shovel 100 and enters the collision zone, block 812 may further cause the applicable warning light to flash, while also causing an external horn (not shown) to be sounded. Additionally or alternatively, block 812 and or block 824 may cause the I/O 408 of the processor circuit 202 to issue a wireless alert at the output 430, causing the wireless transmitter 432 to transmit a warning or collision alert to a receiver located on the object, for causing display of a corresponding warning to the operator of the object.

In another embodiment image recognition may be performed on the images of the object or other steps such as radio frequency identification may be employed to provide an identification of the object that is detected. The object may be configured with an emergency stop system that receives a wireless command signal from the shovel 100 to cause the object to be halted when a possibility of a collision is detected.

In one embodiment, as objects enter and leave the operating ambit of the shovel 100, the processor circuit 202 shown in FIG. 3 may cause a data log to be generated and stored in the data log store 466 of the variable memory 406. For example, detected object sensor values may be logged along with camera images that are associated with activated sensors to provide a record of movements of the object through the operating ambit. Such logs may be later accessed for purposes of auditing shovel performance, either with a view to improving performance or to determining the cause of a collision that may have occurred.

Figure 10:
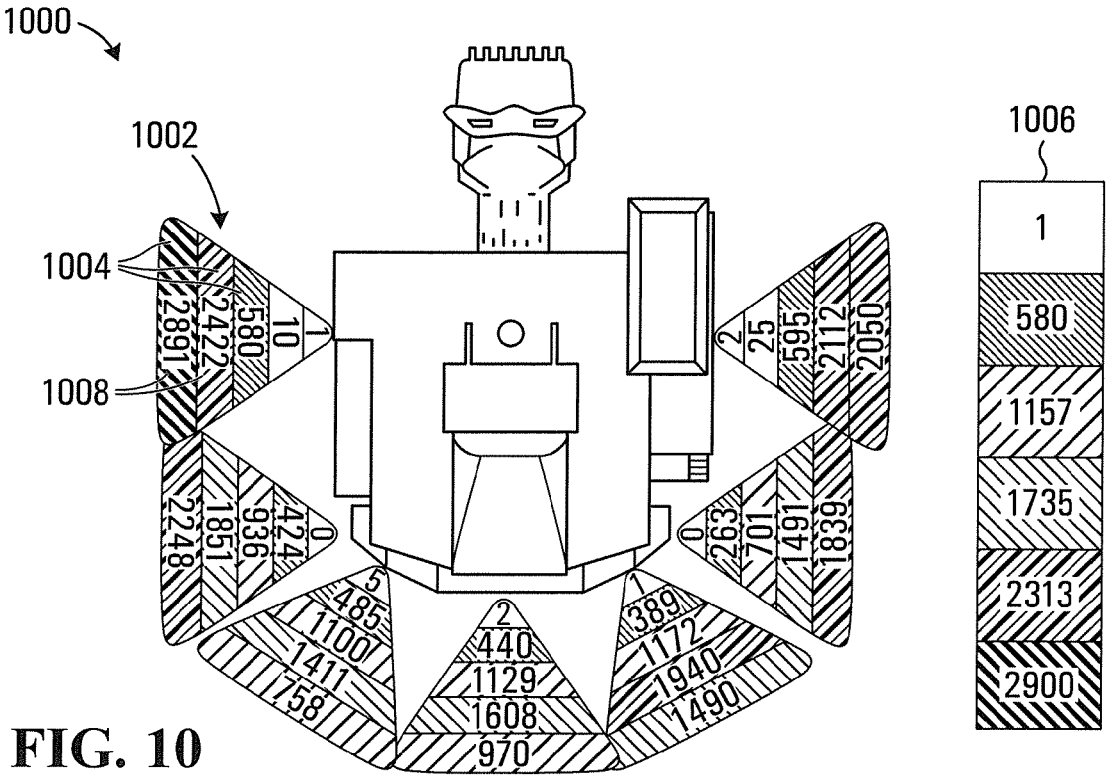
FIG. 10 is a representation of a statistical traffic map generated in accordance with another embodiment of the invention.

Referring to FIG. 10, a portion of a display screen representation in accordance with another embodiment of the invention is shown generally at 1000. The display includes a plan-view image representation of the shovel and it's operating ambit and includes a statistical traffic map 1002 generated on the basis of detected location of obstacles over a period of time. In the embodiment shown, a number of detections during the time period (for example a time period of 16 hours) are depicted by shading or coloring of the detection zones 1004. A legend 1006 may also be provided to map the shading of the detection zones to a number of detections within the zone. Alternatively or additionally the number of detections in the zone may be indicated by a number 1008 displayed within the zone. The representation in FIG. 10 is shown for a double loading example, in which load trucks are positioned on both sides of the shovel during loading resulting in a large number of alerts as indicated by the numbers 1008. During double loading, the second truck is already positioned for loading while the first truck is being loaded, thus increasing the number of detections.

Figure 11:
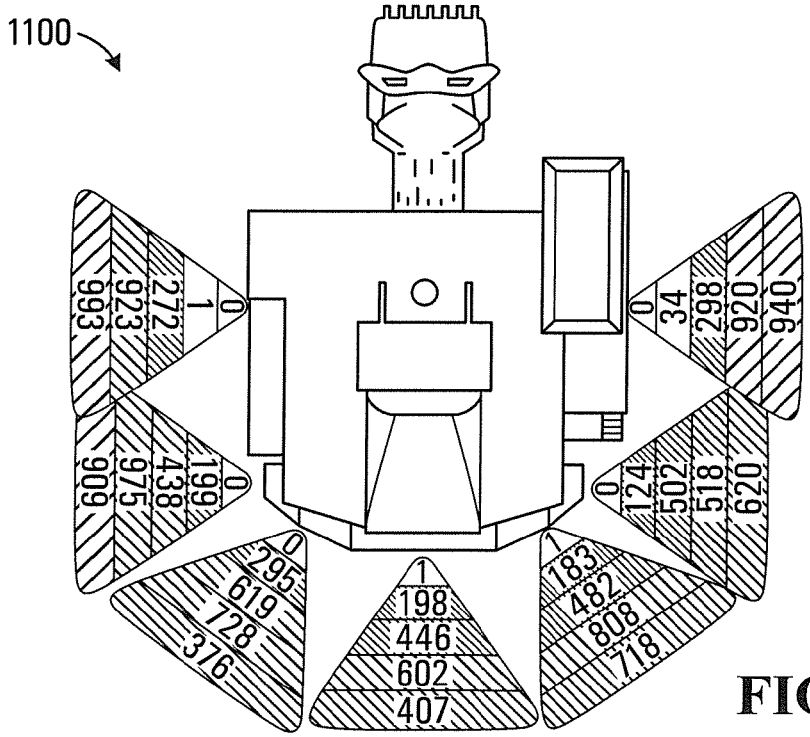
FIG. 11 is a representation of a statistical traffic map generated in accordance with yet another embodiment of the invention.

In another embodiment shown in FIG. 11, a representation 1100 is shown for a single loading example, where only a single load truck is generally present while loading. A subsequent truck only approaches the shovel when the previous truck has completed or is about to complete loading. In this case the number of detections is significantly lower then in the FIG. 10 embodiment and results is a less dangerous loading condition.

The embodiments shown in FIG. 10 and FIG. 11 may provide an aid in training operators and may also provide feedback on operating conditions for the shovel. The generated statistical data may be stored over time in the data log store 466 of the variable memory 406 (shown in FIG. 3) and may be processed in response to an operator request to provide such a statistical analysis, for example.

Advantageously, by defining collision alert regions on the basis of the possibility of portions of the shovel 100 swinging to collide with a detected object in the embodiments described above, the corresponding warning alert regions are rendered more effective since there is no need to include a large safety zone surrounding the shovel within which false warning alerts may be issued for object that are not particularly close to the collision zone. Since mining shovels often have bulldozers and other vehicles working around the shovel, the incidence of false warnings may become a distraction to the operator and thus the non-uniform alert regions defined in the above embodiments reduce the incidence of false warnings.

While specific embodiments of the invention have been described and illustrated, such embodiments should be considered illustrative of the invention only and not as limiting the invention.

What is claimed is:

1. An apparatus for generating an indication of an object within an operating ambit of heavy loading equipment, the apparatus comprising a processor circuit operably configured to:

define an alert region extending outwardly from the loading equipment and encompassing swinging movements of outer extents of the loading equipment during operation;

receive proximity signals from a plurality of sensors disposed about a periphery of the loading equipment, each sensor being operable to generate a proximity signal in response to detecting an object within one of a plurality of detection zones defined for each sensor, said detection zones extending outwardly from said sensor, said proximity signal including information identifying said detection zone within which the object is located, wherein adjacently disposed sensors on the periphery of the loading equipment each have at least one detection zone that overlaps with a detection zone of the adjacently disposed sensor;

process said proximity signals by combining said information identifying respective detection zones associated with the adjacently disposed sensors to determine a location of the object relative to the loading equipment; and initiate an alert when said location falls within said alert region.

2. The apparatus of claim 1 wherein said processor circuit is operably configured to define said alert region by, for each sensor, associating ones of said plurality of detection zones with said alert region.

3. The apparatus of claim 1 wherein said processor circuit is operably configured to define said alert region by receiving positioning information defining a positioning of each sensor on the periphery of the loading equipment.

4. The apparatus of claim 3 wherein swinging movements of the loading equipment during loading operations occur about a pivot and wherein said processor circuit is operably configured to receive information defining a location of said pivot and a location of said extents of the loading equipment.

5. The apparatus of claim 1 wherein swinging movements of the loading equipment during loading operations occur about a pivot and wherein said processor circuit is operably configured to define said alert region by defining a region extending outwardly from said pivot.

6. The apparatus of claim 5 wherein said processor circuit is operably configured to define said region extending outwardly from said pivot by defining a generally cylindrical sector having a radius dimension corresponding to a distance between said pivot and an outermost extent of said outer extents.

7. The apparatus of claim 1 wherein said processor circuit is operably configured to define said alert region by defining at least one of:

a collision region, wherein objects located within said collision region would be disposed in a collision path of the operating equipment; and a warning region extending outwardly from said collision region, wherein objects located within said warning region are outside of said collision region but sufficiently close to said collision region to be in danger of encroaching on said collision region.

8. The apparatus of claim 7 wherein swinging movements of the loading equipment during loading operations occur about a pivot and wherein said processor circuit is operably configured to define said collision region by defining a generally cylindrical sector having a radius dimension corresponding to a distance between said pivot and an outermost extent of said outer extents.

9. The apparatus of claim 8 wherein said processor circuit is operably configured to define said warning region by defining a generally hollow cylinder shaped sector extending outwardly from said collision region.

10. The apparatus of claim 7 wherein said processor circuit is further operably configured to:

determine a pattern of movement between an object within the warning zone with respect to the loading equipment;

determine whether said pattern of movement corresponds to a pattern of movement associated with normal operations of the loading equipment; and wherein initiating said alert comprises issuing an alert only when said pattern of movement does not correspond to a pattern of movement associated with normal operations of the loading equipment.

11. The apparatus of claim 10 wherein swinging movements of the loading equipment during loading operations occur about a pivot and wherein said processor circuit is operably configured to determine whether said pattern of movement of the object corresponds to normal operations of the loading equipment by determining whether movement of the object generally corresponds to a movement about said pivot.

12. The apparatus of claim 1 wherein said processor circuit is operably configured to record location information associated with objects that enter the operating ambit of the loading equipment to facilitate analysis of loading operations.

13. The apparatus of claim 1 wherein the loading equipment comprises at least one camera disposed to capture images of at least a portion of the operating ambit and wherein said processor circuit is operably configured to initiate said alert by causing a view of said at least said portion of the operating ambit to be displayed on a display for viewing by an operator of the loading equipment when the object is located within a field of view of said at least one camera.

14. The apparatus of claim 1 wherein the loading equipment comprises a plurality of cameras disposed to capture images of respective portions of the operating ambit and wherein said processor circuit is operably configured to initiate said alert by selectively displaying a view captured by a camera of said plurality of cameras that is best disposed to provide a view of the object.

15. The apparatus of claim I wherein said processor circuit is operably configured to initiate said alert by at least one of:

causing an audible tone to be produced for warning an operator of said loading equipment;

causing an audible tone to be produced for warning an operator of the object;

causing a visual alert to be displayed on a display associated with operations of the loading equipment;

causing a warning light within view of the operator of the object to be activated;

generating a wireless alert signal for receipt by other equipment located in the vicinity of the operating ambit of the loading equipment; and generating a wireless alert signal for receipt by a dispatch center, the dispatch center being in communication with at least one of an operator of the loading equipment and an operator of the object.

16. The apparatus of claim 1 wherein the loading equipment comprises at least one outwardly directed warning light for providing a warning to an object entering the operating ambit of the loading equipment and wherein said processor circuit is operably configured to initiate said alert by activating said at least one warning light.

17. The apparatus of claim 16 wherein the loading equipment comprises a plurality of outwardly directed warning lights disposed about the periphery of the loading equipment and wherein said processor circuit is operably configured to initiate said alert by selectively activating one of said plurality of warning lights that is disposed to provide a visual alert to an operator of the object.

18. The apparatus of claim 1 wherein said processor circuit is operably configured to further determine an object type associated with the object and to generate a signal operable to halt operation of at least one of the object and the loading equipment when said location falls within said alert region.

19. The apparatus of claim 18 wherein said processor circuit is operably configured to determine said object type by at least one of:

performing image analysis on an image of the object captured by a camera disposed to capture images of at least a portion of the operating ambit within which the object is located;

reading a radio frequency identification associated with the object; and processing the proximity signals produced by said sensors, said sensors being further operably configured to provide information indicative of a shape of detected objects within a coverage region of the sensor.

20. The apparatus of claim 1 wherein the loading equipment comprises one of an electric mining shovel and a hydraulic mining shovel.

21. The apparatus of claim 20 wherein said outer extents comprise a counterweight of said mining shovel.

22. The apparatus of claim 1 wherein said sensor comprises a radar object detection sensor.

23. The apparatus of claim 1 wherein said processor circuit is operably configured to further use said processed proximity signals to generate statistical data representing a number of detections within a coverage region of at least one of said plurality of sensors.

24. The apparatus of claim 23 wherein said processor circuit is operably configured to generate a map representing the number of detections within the coverage region of each of the plurality of sensors.

25. A method for generating an indication of an object within an operating ambit of heavy loading equipment, the method comprising:

defining an alert region extending outwardly from the loading equipment and encompassing swinging movements of outer extents of the loading equipment during operation;

receiving proximity signals from a plurality of sensors disposed about a periphery of the loading equipment, each sensor being operable to generate a proximity signal in response to detecting an object within one of a plurality of detection zones defined for each sensor, said detection zones extending outwardly from said sensor, said proximity signal including information identifying said detection zone within which the object is located, wherein adjacently disposed sensors on the periphery of the loading equipment each have at least one detection zone that overlaps with a detection zone of the adjacently disposed sensor;

processing said proximity signals by combining said information identifying respective detection zones associated with the adjacently disposed sensors to determine a location of the object relative to the loading equipment; and initiating an alert when said location falls within said alert region.

26. The method of claim 25 wherein defining said alert region comprises, for each sensor, associating ones of said plurality of detection zones with said alert region.

27. The method of claim 25 wherein defining said alert region comprises receiving positioning information defining a positioning of each sensor on the periphery of the loading equipment.

28. The method of claim 27 wherein swinging movements of the loading equipment during loading operations occur about a pivot and further comprising receiving information defining a location of said pivot and a location of said extents of the loading equipment.

29. The method of claim 25 wherein swinging movements of the loading equipment during loading operations occur about a pivot and wherein defining said alert region comprises defining a region extending outwardly from said pivot.

30. The method of claim 29 wherein defining said region extending outwardly from said pivot comprises defining a generally cylindrical sector having a radius dimension corresponding to a distance between said pivot and an outermost extent of said outer extents.

31. The method of claim 25 wherein defining said alert region comprises defining at least one of:

a collision region, wherein objects located within said collision region would be disposed in a collision path of the operating equipment; and a warning region extending outwardly from said collision region, wherein objects located within said warning region are outside of said collision region but sufficiently close to said collision region to be in danger of encroaching on said collision region.

32. The method of claim 31 wherein swinging movements of the loading equipment during loading operations occur about a pivot and wherein defining said collision region comprises defining a generally cylindrical sector having a radius dimension corresponding to a distance between said pivot and an outermost extent of said outer extents.

33. The method of claim 32 wherein defining said warning region comprises defining a generally hollow cylinder shaped sector extending outwardly from said collision region.

34. The method of claim 31 further comprising:

determining a pattern of movement between an object within the warning zone with respect to the loading equipment;

determining whether said pattern of movement corresponds to a pattern of movement associated with normal operations of the loading equipment; and wherein initiating said alert comprises issuing an alert only when said pattern of movement does not correspond to a pattern of movement associated with normal operations of the loading equipment.

35. The method of claim 34 wherein swinging movements of the loading equipment during loading operations occur about a pivot and wherein determining whether said pattern of movement of the object corresponds to normal operations of the loading equipment comprises determining whether movement of the object generally corresponds to a movement about said pivot.

36. The method of claim 25 further comprising recording location information associated with objects that enter the operating ambit of the loading equipment to facilitate analysis of loading operations.

37. The method of claim 25 wherein the loading equipment comprises at least one camera disposed to capture images of at least a portion of the operating ambit and wherein initiating said alert comprises causing a view of said at least said portion of the operating ambit to be displayed on a display for viewing by an operator of the loading equipment when the object is located within a field of view of said at least one camera.

38. The method of claim 25 wherein the loading equipment comprises a plurality of cameras disposed to capture images of respective portions of the operating ambit and wherein initiating said alert comprises selectively displaying a view captured by a camera of said plurality of cameras that is best disposed to provide a view of the object.

39. The method of claim 25 wherein initiating said alert comprises at least one of:

causing an audible tone to be produced for warning an operator of said loading equipment;

causing an audible tone to be produced for warning an operator of the object;

causing a visual alert to be displayed on a display associated with operations of the loading equipment;

causing a warning light within view of the operator of the object to be activated;

generating a wireless alert signal for receipt by other equipment located in the vicinity of the operating ambit of the loading equipment; and generating a wireless alert signal for receipt by a dispatch center, the dispatch center being in communication with at least one of an operator of the loading equipment and an operator of the object.

40. The method of claim 25 wherein the loading equipment comprises at least one outwardly directed warning light for providing a warning to an object entering the operating ambit of the loading equipment and wherein initiating said alert comprises activating said at least one warning light.

41. The method of claim 40 wherein the loading equipment comprises a plurality of outwardly directed warning lights disposed about the periphery of the loading equipment and wherein initiating said alert comprises selectively activating one of said plurality of warning lights that is disposed to provide a visual alert to an operator of the object.

42. The method of claim 25 further comprising determining an object type associated with the object and further comprising generating a signal operable to halt operation of at least one of the object and the loading equipment when said location falls within said alert region.

43. The method of claim 42 wherein determining said object type comprises at least one of:

performing image analysis on an image of the object captured by a camera disposed to capture images of at least a portion of the operating ambit within which the object is located;

reading a radio frequency identification associated with the object; and processing the proximity signals produced by said sensors, said sensors being further operably configured to provide information indicative of a shape of detected objects within a coverage region of the sensor.

44. The method of claim 25 wherein the loading equipment comprises one of an electric mining shovel and a hydraulic mining shovel.

45. The method of claim 44 wherein said outer extents comprise a counterweight of said mining shovel.

46. The method of claim 25 wherein said sensor comprises a radar object detection sensor.

47. The method of claim 25 further comprising using said processed proximity signals to generate statistical data representing a number of detections within a coverage region of at least one of said plurality of sensors.

48. The method of claim 47 further comprising generating a map representing the number of detections within the coverage region of each of the plurality of sensors.

49. A system for generating an indication of an object within an operating ambit of heavy loading equipment, the system comprising:

a plurality of sensors disposed about a periphery of the loading equipment, each sensor being operable to generate a proximity signal in response to detecting an object within one of a plurality of detection zones defined for each sensor, said detection zones extending outwardly from said sensor, said proximity signal including information identifying said detection zone within which the object is located, wherein adjacently disposed sensors on the periphery of the loading equipment each have at least one detection zone that overlaps with a detection zone of the adjacently disposed sensor; and a processor circuit operably configured to:

define an alert region extending outwardly from the loading equipment and encompassing swinging movements of outer extents of the loading equipment during operation;

receive said proximity signals from said plurality of sensors;

process said proximity signals by combining said information identifying respective detection zones associated with the adjacently disposed sensors to determine a location of the object relative to the loading equipment; and initiate an alert when said location falls within said alert region.

* * * * *